US008201808B1

(12) United States Patent
Busalacchi

(10) Patent No.: US 8,201,808 B1
(45) Date of Patent: Jun. 19, 2012

(54) MULTI-SIZED WOOD AND METAL STAKE PULLING DEVICE

(76) Inventor: Filippo M. Busalacchi, San Diego, CA (US)

( * ) Notice: Subject to any disclaimer, the term of this patent is extended or adjusted under 35 U.S.C. 154(b) by 406 days.

(21) Appl. No.: 12/613,320

(22) Filed: Nov. 5, 2009

(51) Int. Cl.
*B25C 11/00* (2006.01)
*E21B 19/00* (2006.01)

(52) U.S. Cl. ..... 254/132; 254/30

(58) Field of Classification Search ..... 254/130, 254/131.5, 132, 26 E, 30, 114, 116, 118, 254/119; 269/228
See application file for complete search history.

(56) References Cited

U.S. PATENT DOCUMENTS

| | | | | | |
|---|---|---|---|---|---|
| 301,799 | A | * | 7/1884 | Campbell | 254/23 |
| 1,418,343 | A | * | 6/1922 | White | 254/119 |
| 2,377,652 | A | * | 6/1945 | Sanders | 254/132 |
| 2,424,929 | A | * | 7/1947 | Haney | 254/132 |
| 2,482,950 | A | * | 9/1949 | Toftey | 254/30 |
| 2,511,657 | A | * | 6/1950 | Welch | 254/132 |
| 2,582,284 | A | * | 1/1952 | Sarosdy | 254/132 |
| 2,777,726 | A | * | 1/1957 | Lundgren et al. | 294/92 |
| 3,077,336 | A | * | 2/1963 | McClelland | 254/132 |
| 3,815,875 | A | * | 6/1974 | Koebel, Jr. | 254/132 |
| 3,848,850 | A | * | 11/1974 | Bemis | 254/30 |
| 3,876,096 | A | * | 4/1975 | Latek | 414/549 |
| 4,817,917 | A | * | 4/1989 | Stultz et al. | 254/30 |
| 4,843,687 | A | * | 7/1989 | Kroepelin, Jr. | 24/134 P |
| 5,022,632 | A | * | 6/1991 | Beideck | 254/30 |
| D340,391 | S | * | 10/1993 | Carpenter | D8/51 |
| 5,499,795 | A | * | 3/1996 | Mathews | 254/30 |
| D372,177 | S | * | 7/1996 | Hansen | D8/51 |
| 5,566,924 | A | * | 10/1996 | Shirk | 254/18 |
| 5,597,151 | A | * | 1/1997 | Duncan | 254/199 |
| 5,713,559 | A | * | 2/1998 | McClarin et al. | 254/124 |
| 5,743,340 | A | * | 4/1998 | Giacomini | 172/371 |
| 5,833,215 | A | * | 11/1998 | Vandenburg | 254/30 |
| 6,131,884 | A | * | 10/2000 | Broussard et al. | 254/30 |
| 6,186,479 | B1 | * | 2/2001 | Witter | 254/1 |
| 6,302,376 | B1 | * | 10/2001 | Williams | 254/30 |
| 6,938,937 | B1 | * | 9/2005 | Kinney | 294/50.9 |
| 7,040,602 | B1 | * | 5/2006 | Williams | 254/30 |
| 7,086,640 | B2 | * | 8/2006 | Carmouche | 254/30 |
| 2010/0140575 | A1 | * | 6/2010 | Liou | 254/131.5 |

* cited by examiner

*Primary Examiner* — Lee D Wilson
*Assistant Examiner* — Jamal Daniel

(57) ABSTRACT

A stake pulling device for removing a metal or a wood stake from concrete comprising a base plate for placing on a ground surface; a first support attached to the base plate extending upwardly; a pivot arm pivotally and slidably attached to the top end of the first support arm; a handle component disposed on a first end of the pivot arm; a grip plate attached to the second end of the pivot arm, wherein a stake cavity is disposed in an outer surface of the grip plate, the stake cavity is adapted for receiving the stake; and a pair of jaws pivotally attached to the grip plate above the stake cavity, the pair of jaws comprising teeth for gripping the stake, wherein the pair of jaws can pivot towards each other such that the teeth face each other or face away from each other.

14 Claims, 6 Drawing Sheets

MULTI-SIZED WOOD AND METAL STAKE PULLING DEVICE

FIELD OF THE INVENTION

The present invention is directed to a tool for removing stakes, more particularly to a tool for removing metal or wood stakes after completion of concrete work.

BACKGROUND OF THE INVENTION

Removing metal or wood stakes from concrete can be a particularly difficult task. The present invention features a wood and metal stake pulling device for providing a fast and easy means of removing metal or wood stakes from concrete.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
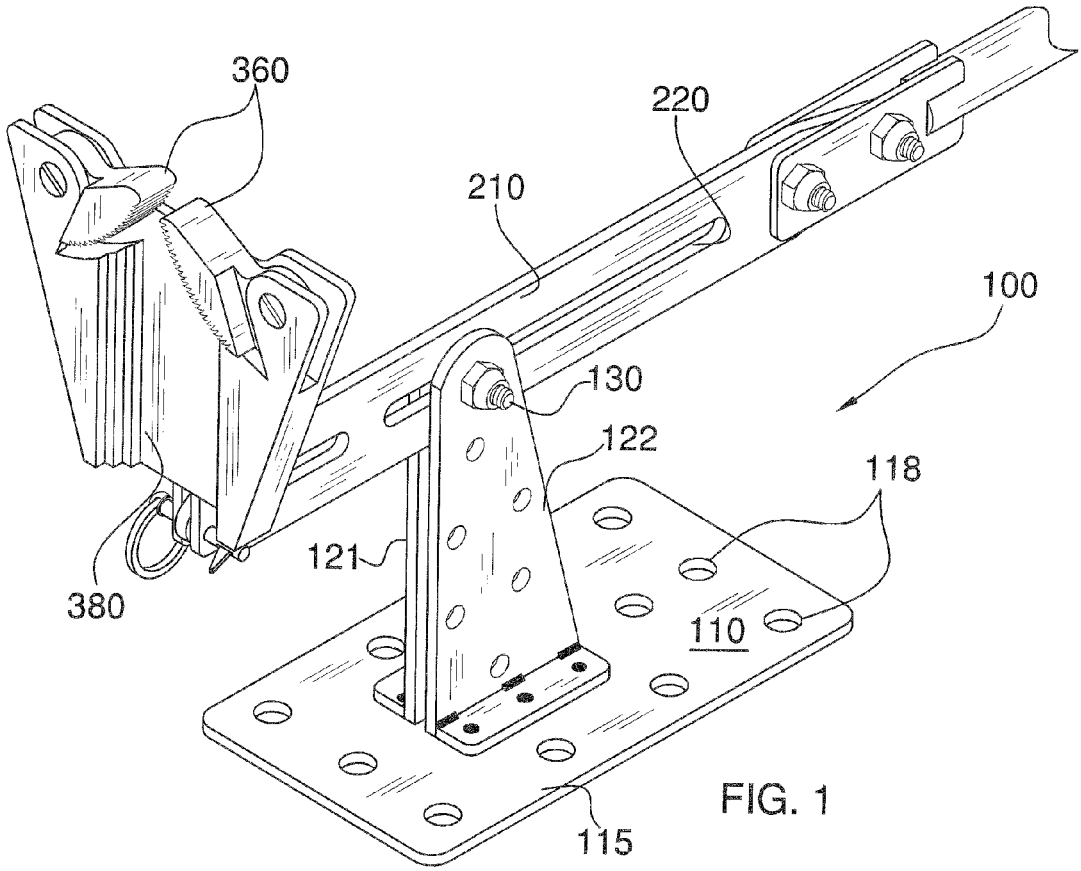
FIG. 1 is a perspective view of the stake pulling device of the present invention.
Figure 2:
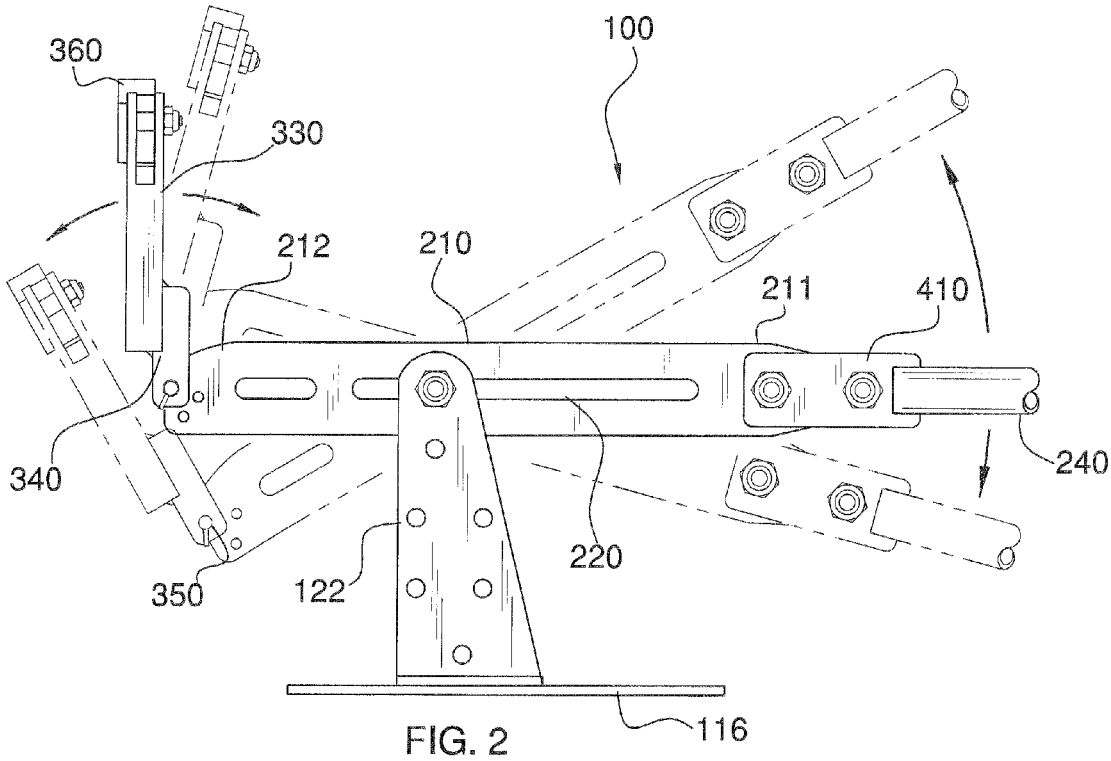
FIG. 2 is a side view of the stake pulling device of FIG. 1.
Figure 3:
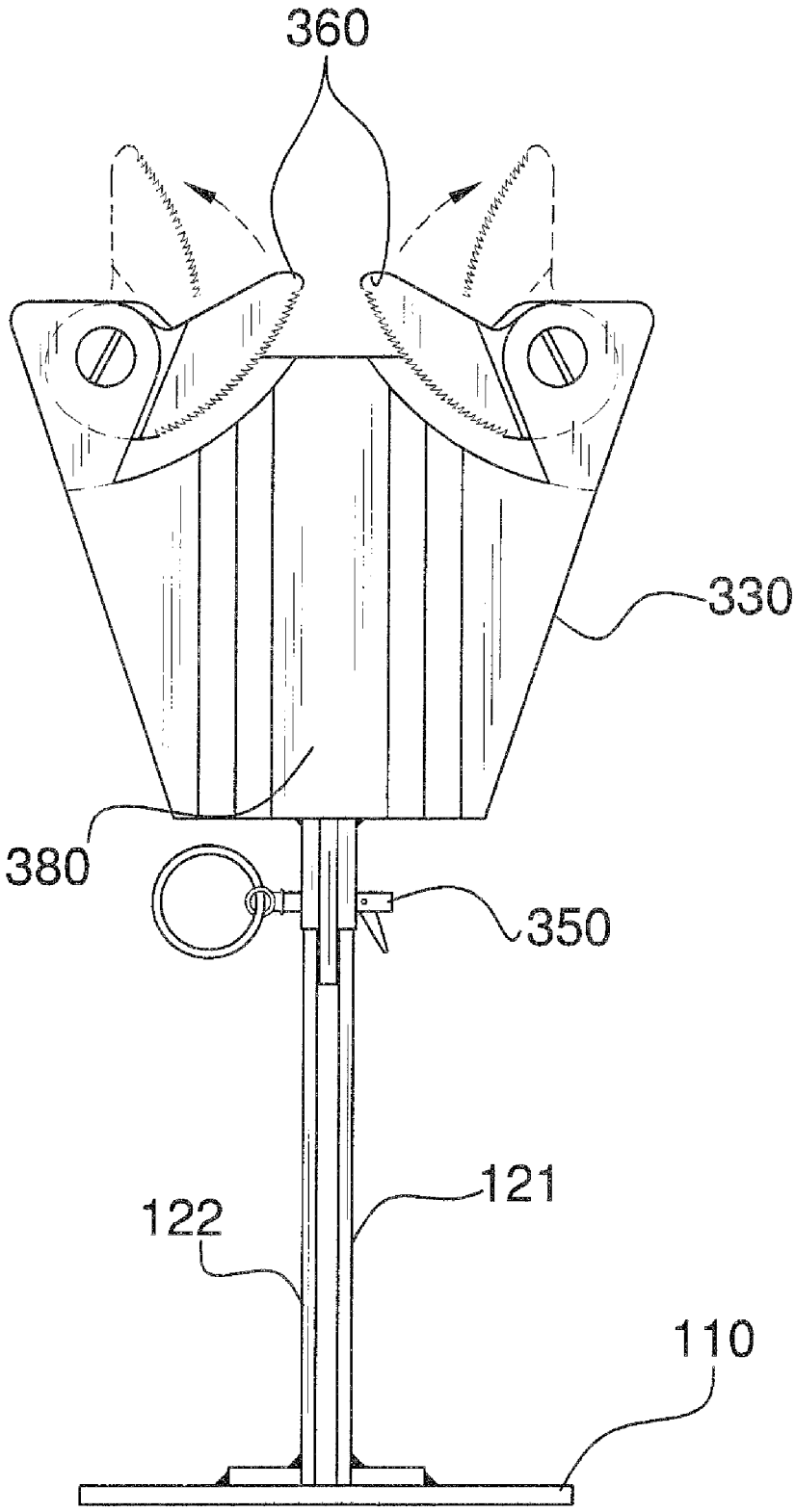
FIG. 3 is a front view of the stake pulling device of FIG. 1.
Figure 4:
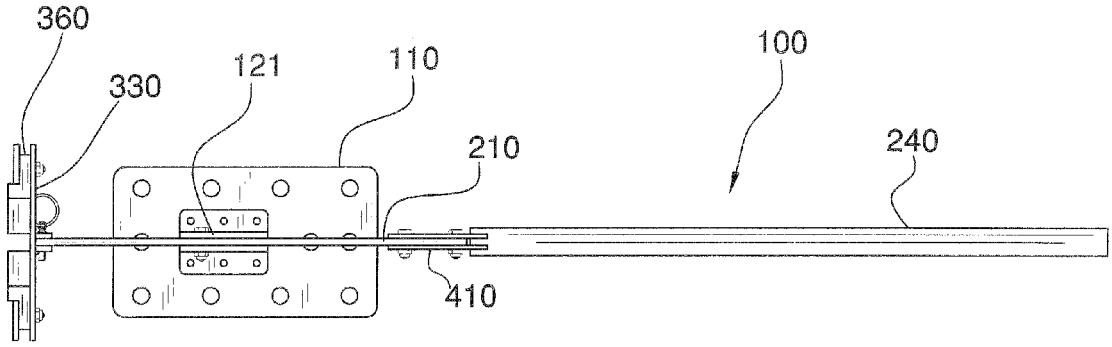
FIG. 4 is a top view of the stake pulling device of FIG. 1.
Figure 5:
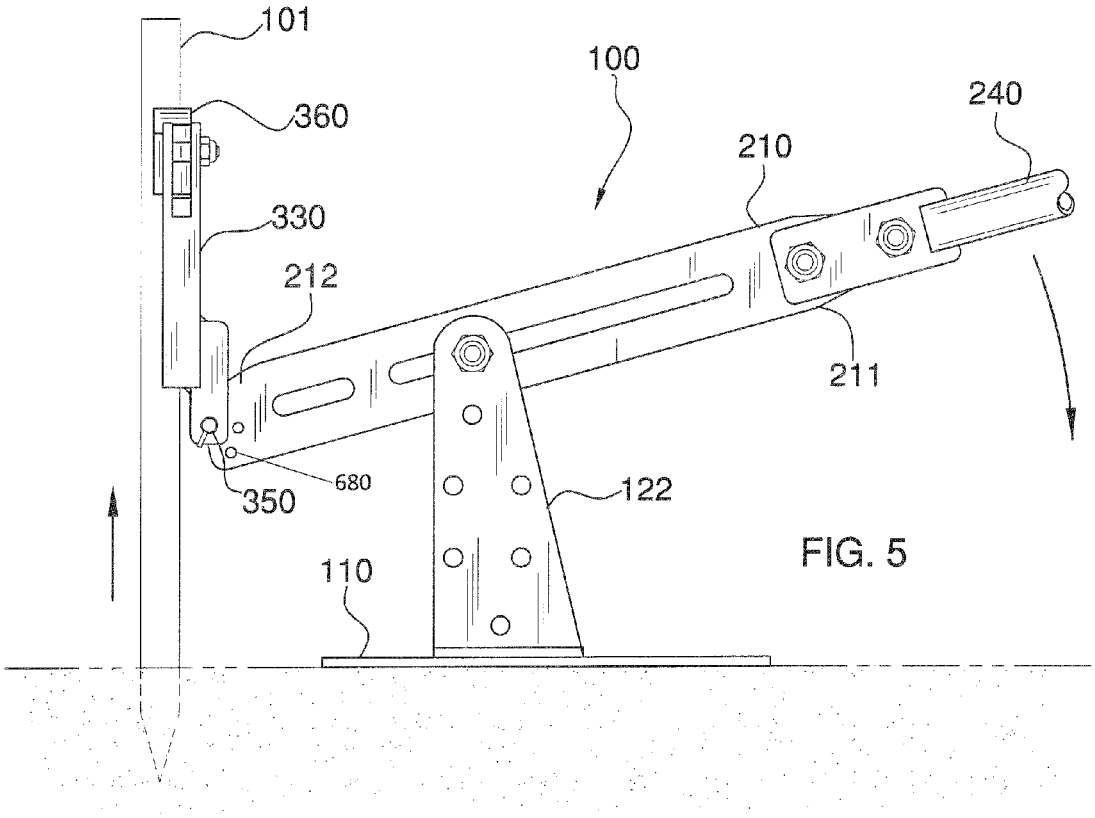
FIG. 5 is a side view of the stake pulling device of FIG. 1, wherein the device is used to remove a stake.
Figure 6:
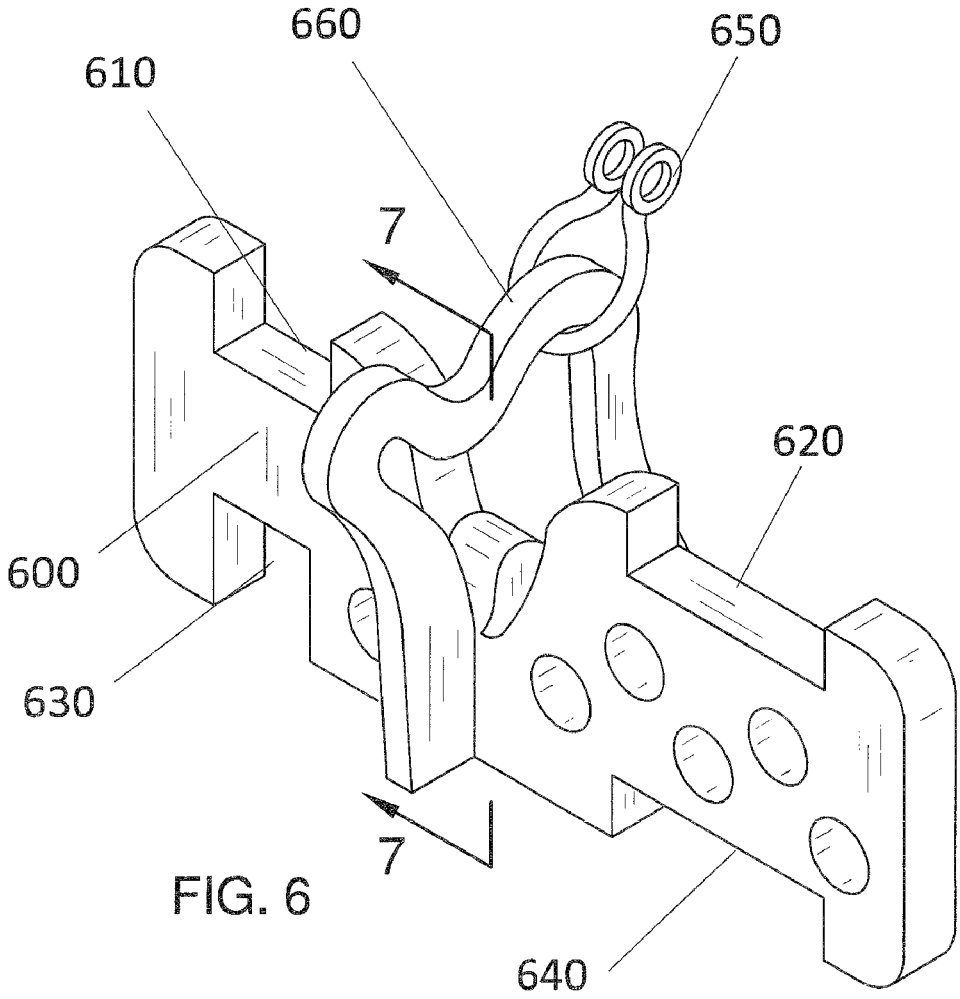
FIG. 6 is a perspective view of the attachment piece of the stake pulling device of the present invention.
Figure 7:
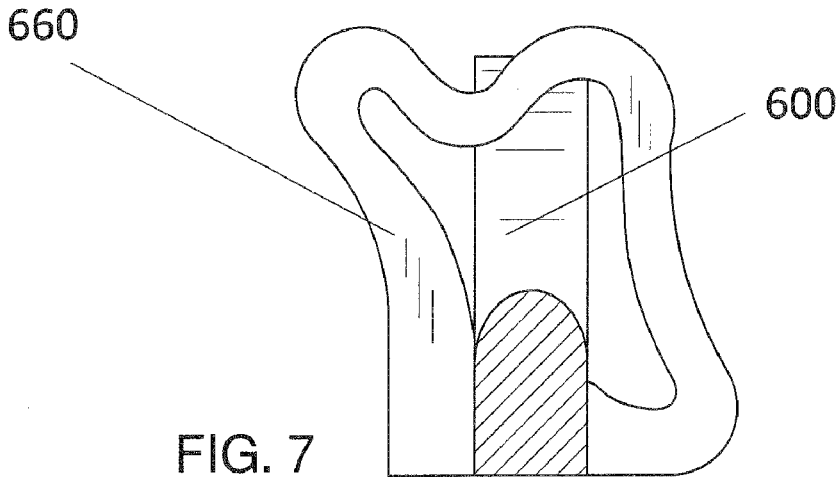
FIG. 7 is a side and cross sectional view of the attachment piece of FIG. 6.

Referring now to FIGS. 1-7, the present invention features a stake pulling device 100 for removing metal or wood stakes 101, for example after completion of concrete work. Without wishing to limit the present invention to any theory or mechanism, it is believed that the stake pulling device 100 of the present invention is advantageous because it may help a user to remove stakes within a few seconds.

The stake pulling device 100 comprises a base plate 110 and support plates that together support an elongated pivot arm 210. The base plate 110 has a top surface 115 and a bottom surface 116. The base plate 110 is for placing on a ground surface. In some embodiments, one or more holes 118 are disposed in the base plate 110. The holes 118 may provide for a more stable positioning on a ground surface, for example if the ground is slightly uneven.

Extending upwardly from the base plate 110 is a first support plate 121 and a second support plate 122. The first support plate 121 and the second support plate 122 are positioned generally parallel to each other. The first support plate 121 and the second support plate 122 have a bottom end and a top end, the bottom ends being attached to the base plate 110.

Attached to the top ends of the support plates or sandwiched between the top ends of the first support plate 121 and the second support plate 122 is an elongated pivot arm 210. The pivot arm 210 is pivotally and slidably attached to the first support plate 121 and the second support plate 122. In some embodiments, the pivot arm 210 has a first slot 220 (e.g., in the middle of the pivot arm 210) through which a bolt 130 is driven. The bolt 130 is attached to the first support plate 121 and the second support plate 122. The pivot arm 210 can pivot about the bolt 130, and the first slot 220 in the pivot arm 210 allows for the pivot arm 210 to slide in a first direction and second direction with respect to the bolt 130. The sliding and pivoting of the pivot arm 210 may allow for appropriate positioning during the stake removal operation.

The pivot arm 210 has a first end 211 and a second end 212. Disposed on the first end 211 of the pivot arm 210 is a handle component 240. In some embodiments, the handle component 240 is attached to the pivot arm 210 via a first attachment means 410, for example a bolt mechanism.

Pivotally attached to the second end 212 of the pivot arm 210 is a gripper component. The gripper component is the portion of the stake pulling device 100 that grips the stake 101. The gripper component comprises a grip plate 330, which is attached (pivotally or fixedly) to the second end 212 of the pivot arm 210. In some embodiments, the grip plate 330 is attached to the pivot arm 210 via an attachment piece 340. In some embodiments, the attachment piece 340 is pivotally attached to the second end 212 of the pivot arm 210 via a removable locking pin 350 (e.g., ½ inch locking pin). In some embodiments, the grip plate 330 is fixedly attached to the attachment piece 340.

The grip plate 330 has a top edge, a bottom edge, and an outer surface. A stake cavity 380 is disposed in the outer surface of the grip plate 330, which is adapted for receiving a stake 101. For example, when the stake pulling device 100 of the present invention is being positioned for stake removal, the stake 101 is inserted into the stake cavity 380 The jaws 360 are pivotally attached to the grip plate 330, for example via bolts. The jaws 360 have a first side surface, a second side surface, a top edge, and a bottom edge. In some embodiments, teeth for gripping the stake 101 are disposed on the bottom edge of the jaws 360. The top edge of the jaws 360 may be pivotally attached to the grip plate 330. The jaws can thus pivot towards each other such that the teeth of the respective jaws face each other or away from each other. The pivoting of the jaws 360 may provide for enhanced gripping of the stake 101 during the stake removal procedure.

In some embodiments, the stake pulling device 100 of the present invention further comprises an attachment piece 600. The attachment piece 600 may allow a user to remove metal stakes in addition to wood stakes. The attachment piece 600 may be a generally flat panel having a first side edge, a second side edge, a top edge, a bottom edge, a front surface, and a back surface. The attachment piece 600 may be constructed in a variety of sizes. As an example, in some embodiments, the attachment piece 600 is between about 5 to 7 inches (e.g., 6 inches) in length as measured from the first side edge to the second side edge. In some embodiments, the attachment piece 600 is between about 0.5 to 1 inch in thickness (e.g., ¾ inch) as measured from the front surface to the back surface. In some embodiments, the attachment piece 600 is between about 2 to 3 inches in height (e.g., 2.25 inches) as measured from the top edge to the bottom edge. The attachment piece 600 is not limited to the aforementioned dimensions.

Disposed in the edges of the attachment piece 600 is a plurality of notches. For example, a first notch 610 is disposed in the top edge (e.g., near the first side edge), a second notch 620 is disposed in the top edge (e.g., near the second side edge), a third notch 630 is disposed in the bottom edge (e.g., near the first side edge), and a fourth notch 640 is disposed in the bottom edge (e.g., near the second side edge), Each notch has a different width. The notches are for accommodating various sized stakes (e.g., metal stakes).

The attachment piece 600 is attached to the stake pulling device 100, for example attached to the second end 212 of the pivot arm 210 (e.g., under the locking pin 350) via an attachment means. In some embodiments, attachment holes 680 are disposed in the second end 212 of the pivot arm, and the attachment piece 600 is attached to the attachment holes 680 via the attachment means. In some embodiments, the attachment means includes via a shackle 650 and locking pin. In some embodiments, the shackle 650 is attached to an attachment bar 660, which is attached to the attachment piece 600.

In some embodiments, a stopper pin (e.g., a 5/16 inch pin) is disposed near the attachment holes 680. The stopper pin can help prevent the gripper component from going too far forward or backward.

The attachment piece 600 can be attached to the device 100 (and left on the device 100) without interfering with the device. Alternatively, a user can remove the attachment piece 600 if he/she desires.

The present invention also features a method of removing a stake. The method comprises obtaining a stake pulling device 100 of the present invention. The method further comprises placing the base 110 on a ground surface and positioning the device 100 such that the stake 101 is inserted into the stake cavity 380 when the jaws 360 are pivoted away from each other (e.g., see FIG. 3). The jaws 360 can then be pivoted downwardly to grip the stake 101. A user can then push down on the handle 240, which causes the gripping component to be raised along with the stake 101.

The stake pulling device 100 may be constructed from a variety of materials and in a variety of sizes. In some embodiments, the stake pulling device 100 is constructed from a material comprising a metal, for example steel.

The following the disclosures of the following U.S. Patents are incorporated in their entirety by reference herein: U.S. Pat. No. 3,815,875; U.S. Pat. No. 6,302,376; U.S. Pat. No. 7,040,602; U.S. Pat. No. 2,424,929; U.S. Pat. No. 2,582,284; U.S. Pat. No. 5,022,632; U.S. Pat. No. 6,131,884; U.S. Pat. No. 6,186,479.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A stake pulling device for removing a metal or a wood stake from concrete, said stake pulling device comprising:

(a) a base plate for placing on a ground surface;

(b) a first support plate having a first end attached to the base plate and a second end extending upwardly from the base plate;

(c) a pivot arm pivotally and slidably attached to the top end of the first support plate, the pivot arm comprising a first slot disposed in a middle portion through which a bolt is driven, the bolt being attached to the first support plate, wherein the first slot allows the pivot arm to pivot and slide about the bolt;

(d) a handle component disposed on a first end of the pivot arm;

(e) a grip plate attached to the second end of the pivot arm, wherein a stake cavity is disposed in an outer surface of the grip plate, the stake cavity is adapted for receiving the stake; and (f) a pair of jaws pivotally attached to the grip plate above the stake cavity, the pair of jaws comprising teeth for gripping the stake, wherein the pair of jaws can pivot towards each other such that the teeth face each other or face away from each other.

2. The stake pulling device of claim 1, wherein one or more holes are disposed in the base plate.

3. The stake pulling device of claim 1 further comprising a second support plate positioned generally parallel to the first support plate.

4. The stake pulling device of claim 1, wherein the grip plate is attached to the second end of the pivot arm via an attachment piece.

5. The stake pulling device of claim 4, wherein the attachment piece is pivotally attached to the second end of the pivot arm via a removable locking pin.

6. The stake pulling device of claim 1, wherein the handle component is attached to the pivot arm via a bolt mechanism.

7. The stake pulling device of claim 1 further comprising an attachment piece for allowing a user to remove metal stakes.

8. The stake pulling device of claim 7, wherein a first notch is disposed in a top edge of the attachment piece near a first side edge and a second notch is disposed in the top edge of the attachment piece near a second side edge.

9. The stake pulling device of claim 7, wherein a third notch is disposed in a bottom edge of the attachment piece near the first side edge and a fourth notch is disposed in a bottom edge of the attachment piece near the first side edge.

10. The stake pulling device of claim 7, wherein the attachment piece is attachable to the second end of the pivot arm via an attachment means.

11. The stake pulling device of claim 10, wherein the attachment piece is attachable to an attachment hole disposed in the second end of the pivot arm.

12. The stake pulling device of claim 10, wherein the attachment means includes a shackle and locking pin.

13. The stake pulling device of claim 1 further comprising a stopper pin disposed in the second end of the pivot arm for helping to prevent the grip plate from going too far forwardly or backwardly.

14. A method of removing a stake, the method comprises (a) obtaining a stake pulling device comprising:

(i) a base plate for placing on a ground surface;

(ii) a first support plate having a first end attached to the base plate and a second end extending upwardly from the base plate;

(iii) a pivot arm pivotally and slidably attached to the top end of the first support arm, the pivot arm comprising a first slot disposed in a middle portion through which a bolt is driven, the bolt being attached to the first support plate, wherein the first slot allows the pivot arm to pivot and slide about the bolt;

(iv) a handle component disposed on a first end of the pivot arm;

(v) a grip plate attached to the second end of the pivot arm, wherein a stake cavity is disposed in an outer surface of the grip plate, the stake cavity is adapted for receiving the stake; and (vi) a pair of jaws pivotally attached to the grip plate above the stake cavity, the pair of jaws comprising teeth for gripping the stake, wherein the pair of jaws can pivot towards each other such that the teeth face each other or face away from each other;

(b) placing the base on a ground surface;

(c) positioning the device such that the stake is inserted into the stake cavity when the jaws are pivoted away from each other;

(d) pivoting the jaws downwardly to grip the stake; and (e) pushing down on the handle to cause the grip plate to be raised along with the stake.

* * * * *